73-151 SR
8/9/77 XR 4,040,189

United States Patent [19] [11] 4,040,189
LaCoste [45] Aug. 9, 1977

[54] METHOD AND APPARATUS FOR LEVELING AN INSTRUMENT IN A WELL BORE

[75] Inventor: Lucien J. B. LaCoste, Austin, Tex.

[73] Assignee: La Coste and Romberg, Inc., Austin, Tex.

[21] Appl. No.: 725,543

[22] Filed: Sept. 22, 1976

[51] Int. Cl.[2] ..... F21B 47/022
[52] U.S. Cl. ..... 33/304; 33/312; 33/313; 73/151; 175/45
[58] Field of Search ..... 33/304, 312, 313; 73/151; 175/44, 45

[56] References Cited

U.S. PATENT DOCUMENTS

| | | | |
|---|---|---|---|
| 845,875 | 3/1907 | Lewis | 33/304 |
| 1,845,889 | 2/1932 | Schoalcraft | 33/304 |
| 2,614,334 | 10/1952 | Hildebrandt | 33/312 |
| 3,555,691 | 1/1971 | Jacoby | 33/312 |

FOREIGN PATENT DOCUMENTS

| | | | |
|---|---|---|---|
| 221,505 | 6/1958 | Australia | 33/313 |

*Primary Examiner*—Steven L. Stephan
*Attorney, Agent, or Firm*—Vinson & Elkins

[57] ABSTRACT

The apparatus includes a housing in which a frame is rotationally mounted, an instrument which is pivotally mounted about two axes within said frame, level sensing devices on the instrument to detect the tilt of the instrument about said two axes, and means for tilting the instrument within the frame so that the instrument's reference axis may be brought to a substantially vertical position when the apparatus is within an inclined well bore. The instrument is mounted unsymmetrically within the frame so that the instrument may be tilted in one direction on one axis a much greater amount than on the other axis and in the other direction. The method steps include the steps of detecting the level position of the instrument along the two axes, rotating the frame within the housing to orient the instrument so that its large range tilt capacity is brought into position to correct the tilt of the instrument and tilting the instrument within the frame to bring the reference axis of the instrument to a substantially vertical position.

16 Claims, 8 Drawing Figures

METHOD AND APPARATUS FOR LEVELING AN INSTRUMENT IN A WELL BORE

BACKGROUND OF THE INVENTION

In the drilling and production of wells many instruments such as gravity meters are lowered into the well bore. Such instruments function most effectively if their reference axis can be positioned substantially vertically. In the drilling of wells, the well bores have varying inclinations, sometimes intentionally in directional drilling but most often just as the result of normal drilling operations in which the drill bit does not proceed vertically.

The use of instruments within a well bore dictates that the instrument be sufficiently small so that it may be lowered into the well bore. Thus the controlling dimension for the instrument is the diameter of the well bore. This restricts the size of the housing for the instrument and also the degree of tilt which may be achieved to correct for well bore inclination. The design of well instruments is not limited in longitudinal length because an increase in length along a well bore does not require that the bore be enlarged as increasing the diameter would require.

SUMMARY

The present invention relates to an improved method of and apparatus for leveling an instrument within a well bore. The improved apparatus includes a pressure tight sealed housing having a transverse dimension capable of passing through the well bore and a longitudinal dimension sufficient to accommodate the apparatus, a frame rotatively mounted within the housing and an instrument mounted by and tiltable with respect to the frame with the instrument being unsymmetrically mounted within the frame. The improved method includes the steps of detecting the tilt of the instrument about two axes, rotating the frame within the housing so that the major tilting capacity of the instrument is aligned with the direction the instrument is to be tilted to level the instrument and the other axis is substantially horizontal and then tilting the instrument to bring its reference axis to a substantially vertical position.

An object of the present invention is to provide an improved apparatus which allows an instrument to be leveled in well bores with greater inclination than could be accomplished in the prior art.

Another object is to provide an improved apparatus for leveling an instrument in a well bore which is simple and easy to operate from the surface.

A further object is to provide an improved method and apparatus for leveling an instrument in a well bore which requires only a rotational orientation of the instrument within the well bore and a major tilt of the instrument along one axis to accommodate the inclination of the well bore.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENT

Figure 1:
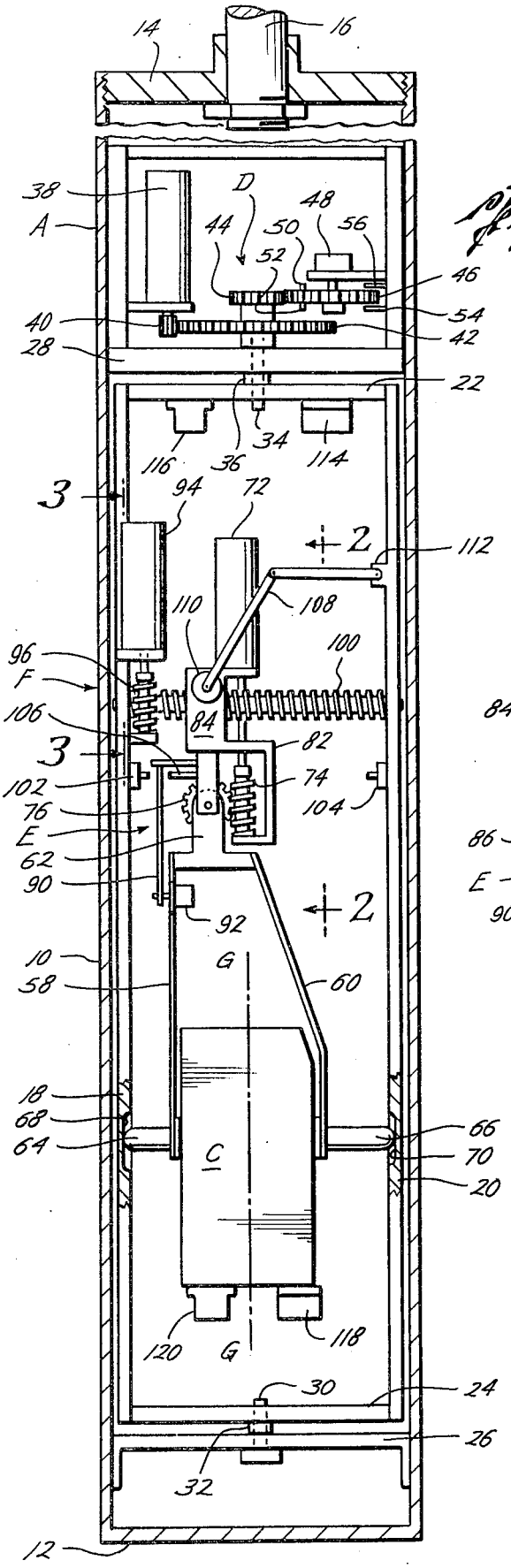
FIG. 1 is a longitudinal sectional view of the improved apparatus of the present invention.
Figure 2:
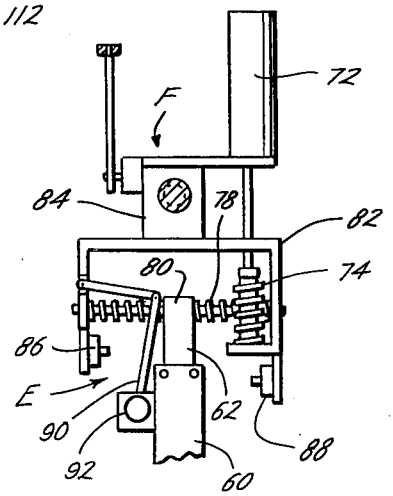
FIG. 2 is a sectional view taken along line 2—2 in FIG. 1 to show the details of the minor tilting means.
Figure 3:
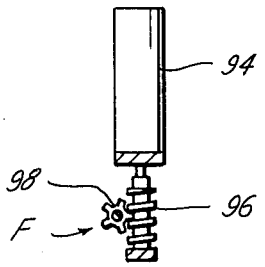
FIG. 3 is another sectional view taken along line 3—3 in FIG. 1 to show additional details of the major tilting means.

The improved apparatus of the present invention includes the pressure tight housing A, the frame B which is positioned within the housing as hereinafter stated and is sufficiently loose with respect thereto to be rotated and the instrument C which is mounted on the frame as hereinafter more fully described. A suitable means D is provided for rotating the frame about its longitudinal axis with respect to the housing A. A means E is provided for tilting the support means for the instrument C about an axis transversely to the longitudinal axis of the frame and housing and a means F is provided for tilting the instrument about an axis normal to the longitudinal axis of the frame and housing and to the axis about which the means E tilts the instrument. The instrument C has a reference axis designated G—G which axis should be vertically positioned for the best performance in the operation of the instrument C. A typical type of instrument which instrument C represents would be a well bore gravity meter which is commonly used in the petroleum industry.

The housing A is a fluid tight case capable of withstanding pressures to which the apparatus is to be exposed in well bores and includes a generally tubular body 10 having an integral bottom 12 and the top 14 which is adapted to be releasably connected to the tubular body 10 as shown. The multiple cable 16 on which the apparatus of the present invention is lowered in a well bore is secured in the top 14 and includes all of the electrical connections extending from the apparatus of the present invention to the surface (not shown). While cable 16 carries all of the power and signals between the apparatus from the surface, the individual connections from the cable 16 to the elements of the apparatus are not shown in order to avoid confusing the components of the apparatus with the electrical wiring.

The frame B includes the side bars 18 and 20, the upper disc 22 which connects between the two side bars at the upper ends thereof and the lower disc 24 which connects between the lower ends of the side bars. The frame B is mounted within the housing A so that it may be rotated about an axis which is substantially the longitudinal axis of the housing A. The means for rotationally mounting the frame within the housing includes the lower cup 26 and the upper cup 28 both of which fit tightly into the interior of the housing A but will slide longitudinally therein, the pin 30 which pivotally mounts the lower cup 26 to the lower disc 24 of the frame with the washer 32 therebetween or other suitable means to provide relatively friction-free rotation thereabout included between the cup 26 and the disc 24, and the pin 34 which is secured to the upper disc 22 and rotatable in the upper cup 28 and includes a washer 36 therebetween or other suitable means to provide a relatively friction-free rotation.

Since for the operation of the improved apparatus of the present invention it is desired that the frame B be rotatable with respect to the housing A about the longitudinal axis of the housing, a suitable rotation driving means is provided. Such driving means includes the motor 38 with the spur gear 40 which drives the main gear 42 mounted on the pin 34. Thus the pin rotates within the upper cup 28 and is suitably secured to the upper disc 22 of the frame so that when the pin 34 is rotated, the frame B is caused to rotate. Additionally, the gear 44 is also rotated with the gear 42 and drives the gear 46 which drives potentiometer 48. Also the pins 50 and 52 extending from the gear 48 coact with the limit switches 54 and 56 to limit the rotation of the frame with respect to the cup 28 to avoid excess twisting of the wires extending into the frame B. The potentiometer 48 provides an indication at the surface as to how much the frame B has been rotated.

The instrument C is mounted within the frame B by suspending the instrument on the links 58 and 60 which extend downwardly from the arm 62 which forms a part of the nut for the tilting means E. The pins 64 and 66 extend outward from the side of the connection of the arms 58 and 60 to the instrument C and have their rounded ends positioned within the slots 68 and 70 respectively defined in the inner sides of the frame side bars 18 and 20.

The minor adjustment about an axis coplanar with FIG. 1 to the position of the instrument C is made by the tilting means E. This is accomplished by operation of the motor 72 which drives the worm 74. Rotation of the worm 74 causes the gear 76 to be rotated. The gear 76 is connected to the screw 78 around which the nut 80 is positioned and rides. Thus as motor 72 is turned in either direction, the screw 78 is rotated and the nut 80 is caused to move back and forward along the screw 78 to provide an adjustment of the position of the instrument along the axis of the screw 78. The tilting means E is supported from the tilting means F by means of the yoke 82 which extends downwardly to support the lower end of the worm 74 and also supports and allows rotation of the screw 78 at both ends thereof. The yoke 82 is connected to the nut 84 of the tilting means F. Limit switches 86 and 88 are mounted on the yoke 82 as shown and are adapted to engage the nut 80 or the link 60 to shut off the operation of the motor 72 as the nut 80 reaches the limit of its travel in either direction.

The pivoted arm 90 connects to the potentiometer 92 and to the yoke 82 as shown. The movement of the nut 80 along the screw 78 causes the portion of the arm 90 to pivot and to cause a motion in the potentiometer which thereby provides an indication at the surface of the exact position of the nut 80 on the screw 78.

The tilting means F includes the motor 94 which drives the worm 96. The worm 96 drives the gear 98 which is secured to the screw 100. From this it can be seen that operation of the motor 94 causes the screw 100 to rotate whereby the nut 84 moves axially along the screw 100 as it is rotated. The screw 100, the worm 96 and the motor 94 are all suitably supported from the frame as shown. The limit switches 102 and 104 are suitably mounted on the side bars 18 and 20 of the frame B and are engaged by the yoke 82 and the bar 106 to limit the movement of the nut 84 along the screw 100. The switches act in the usual manner by shutting off the motor 94. The arms 108 connect from the potentiometer 110 to the lug 112 on the side bar 20. Thus, as screw 100 is rotated and the nut 84 moves therealong, the arms 108 are caused to pivot thereby moving the potentiometer 110. If properly calibrated, the potentiometer 110 provides an indication of the position of nut 84 on the screw 100.

The level indicating means 114 and 116 are positioned on the under side of the disc 22 and are designed to provide an indication of level of the disc 22 in two axes normal to each other and normal to the longitudinal axis of the housing A. It is preferred that these two axes be parallel with the axes of the screw 100 and the screw 78. Additionally, level sensing and indicating means 118 and 120 are secured to the instrument C as shown and also provide the indications of level on axes parallel to the axes of the screws 78 and 100. In the nut-screw combinations just described, it is preferred that the type of connection be a ball bearing drive similar to that used in automobile steering drives and which is commonly known. This type of drive greatly reduces friction and allows the use of relatively small motors 72 and 94.

As can be seen from the foregoing description of the improved apparatus of the present invention, means are provided for adjusting the position of the frame B and the instrument C with respect to the housing A about the longitudinal axis of the housing A and for tilting the instrument C about two other transverse axes which are normal to each other and to the longitudinal axis of the housing A.

The tilting means F provides the greatest degree of tilt since the arm 60 is tapered inwardly and the position of the instrument is unsymmetrically mounted or offset to the left in FIG. 1 from the center line of the frame B and housing A. With this offset position of the instrument C, a much greater degree of correction is available, i.e., the instrument may be tilted at a much greater angle with respect to the longitudinal center line of the housing A and thus with respect to the center line of the well bore than if the instrument were centrally mounted. To utilize this feature, it is thus preferred that the frame B be rotated to a position at which the large degree of tilt available from the tilting means F be in the direction to correct the reference axis G—G of the instrument C to be substantially vertical.

When the apparatus of the present invention is to be run in a well bore, it is preferred that the two tilting means be adjusted approximately to zero the outputs of the potentiometers 92 and 110. If desired, this may be done by operating the tilting means F to move the nut 84 to its left hand position on the screw 100 thereby activating the limit switch 102. Additionally, this first step may be handled by causing the indications of the level indicators 114 and 116 to have the same relative indication as the level indications of the level indicators 118 and 120. The level indicator 120 is oriented on the instrument C to have a maximum response to the screw 78 and the level indicator 118 is oriented on the instrument C to have a maximum response to the screw 100. Then rotating means D is actuated until the indication on the level indicator 120 is approximately zero and there is a positive indication reading from the level indicator 118 to indicate that the major tilting range of means F is in the direction to level the instrument. Thereafter, the two tilting means E and F are actuated to bring the level indications of the indicators 118 and 120 to zero. The adjustment of the tilting means E is a relatively minor adjustment since it is preferred that substantially all of this adjustment be obtained by the rotation of the frame within the housing A.

It should be noted that the operation of the tilting means E may be omitted if an adjustment is made before inserting the apparatus into the housing A which permits aligning the axis G—G with the rotational axis. With this adjustment made, care must be taken to assure that the indication of the level indicator 120 is brought to a substantially zero tilt or horizontal indication by the rotation of the frame B within the housing A before proceeding to adjust the transverse axis by actuation of the tilting means F. It is suggested further that after the tilting of the tilting means F to adjust level indicator 118 to zero that a trim rotation be supplied to assure proper leveling. In the event tilting means E is omitted from remote operation, axial adjustment of the device to provide the reference axis of the instrument C to a substantially vertical position will be directly affected by improper setting of the position of the nut 80 on the screw 78.

Figure 6:
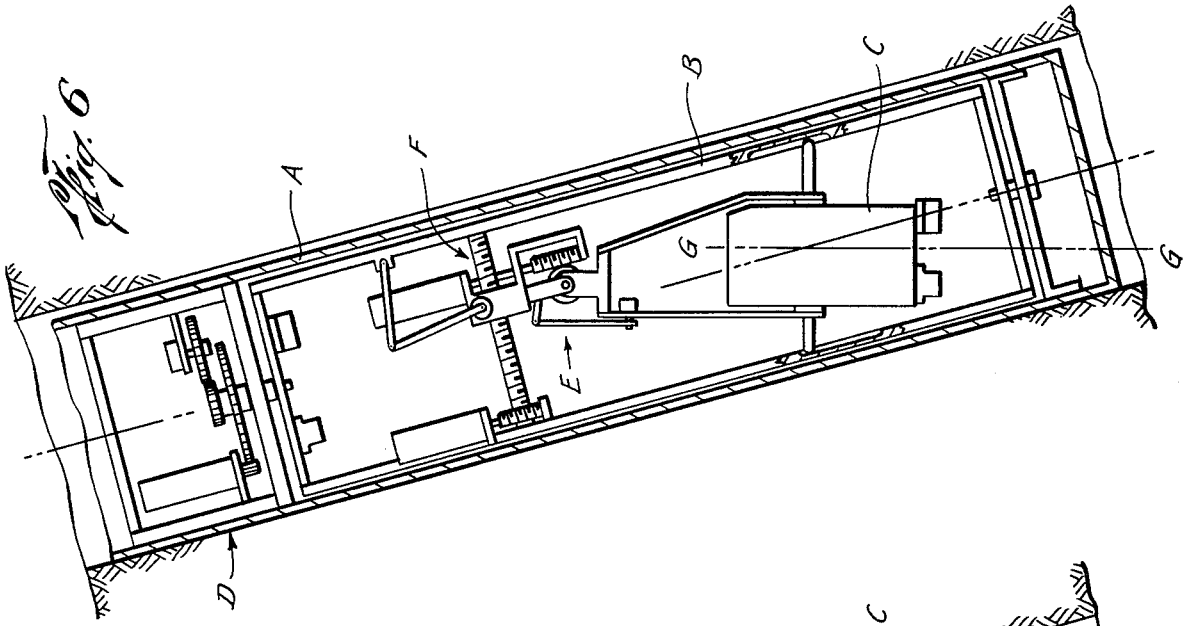
FIG. 6 is another similar view illustrating the verticality of the reference axis of the instrument after the operation of the major tilting means.
Figure 5:
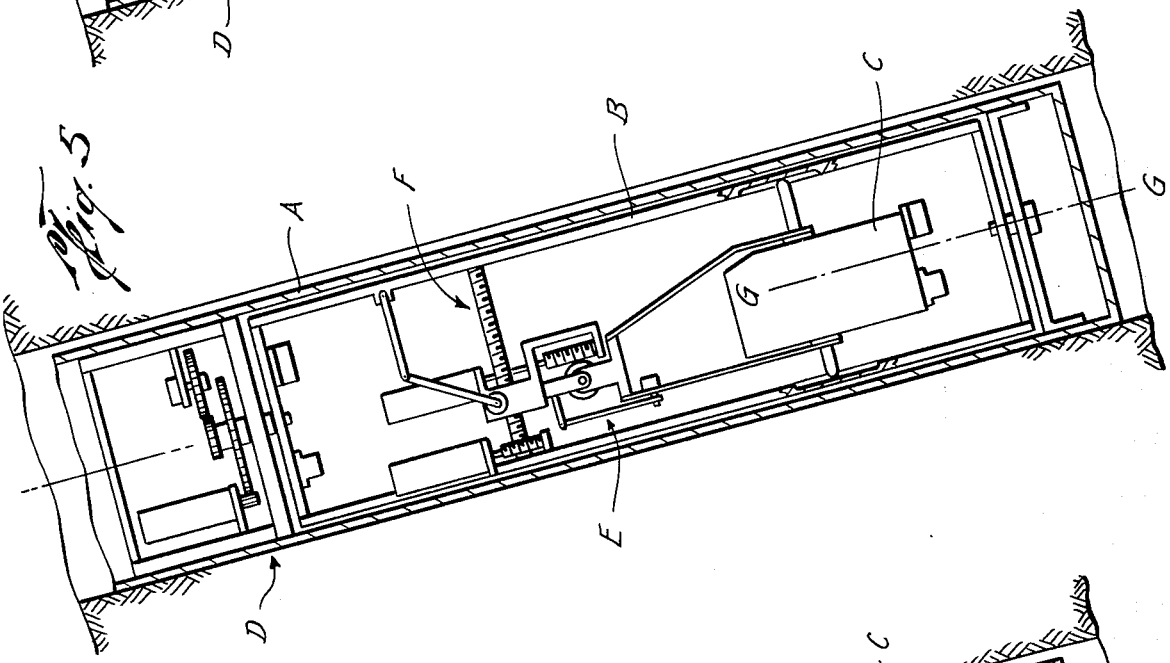
FIG. 5 is a view similar to FIG. 4 showing the rotating of the frame and instrument into position for the operation of the major tilting means.
Figure 4:
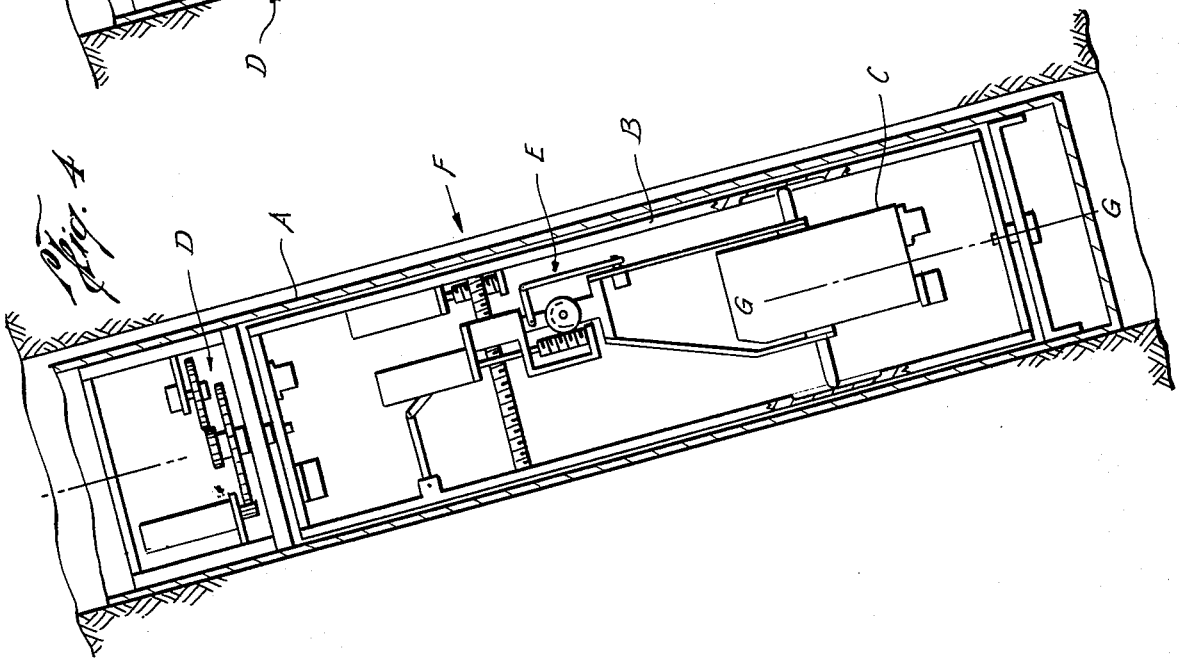
FIG. 4 is a schematic sectional view of the improved apparatus of the present invention positioned in an inclined well bore.

An example of the method steps of the present invention is illustrated in FIGS. 4, 5 and 6. In FIG. 4, the apparatus of the present invention is being run into a bore hole which is inclined as shown in the FIG. 4. As can be seen, the axis of the tilting means F is inclined but the direction of major correction for such tilting means is in the direction opposite to the desired direction for the tilting. For this reason, the frame B must be rotated to the position shown in FIG. 5. It is clear from FIGS. 4 and 5 that the instrument C is oriented to have its reference axis G—G substantially parallel to the longitudinal axis of the housing A as it is run in the well bore.

With the device rotated to the position shown in FIG. 5, the tilting means E would be in a position normal to the paper and this axis would be substantially horizontal. To bring the reference axis G—G of the instrument C to its substantially vertical position, the tilting means F is actuated to the position illustrated in FIG. 6. With the instrument C in this position, readings may be taken, thereafter the instrument can be further lowered in the well bore. It is recommended that before proceeding to the next instrument reading that the reference axis G—G of the instrument C be brought to a position substantially parallel to the longitudinal axis of the housing A.

Figure 7:
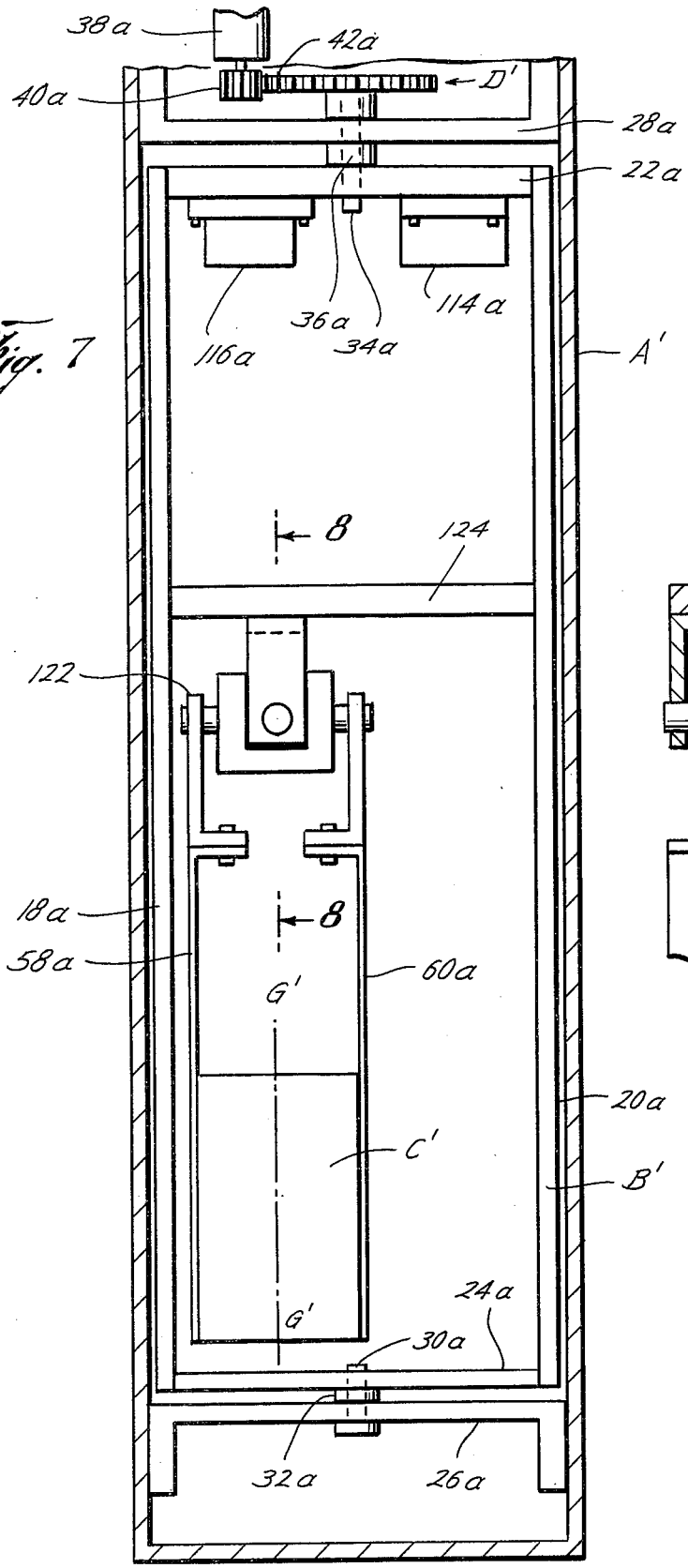
FIG. 7 is a longitudinal sectional view of a modified form of the improved apparatus of the present invention.
Figure 8:
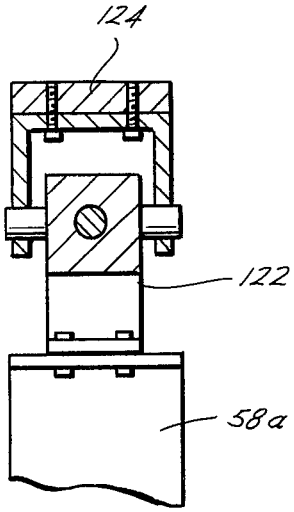
FIG. 8 is a partial sectional view taken along line 8—8 in FIG. 7 to show the gimbal mounting.

For applications in which leveling by gravity is adequate, the invention can be simplified as shown in FIGS. 7 and 8. The instrument C′ to be leveled is shown supported by the links **58*a* and 60*a* which connect to the gimbal 122, which is attached unsymmetrically to the bar 124 as shown. The gimbal 122 includes the usual low friction ball bearings (not shown) so that the force of gravity will level the instrument with only a small error. The unsymmetrical attachment of the gimbal 122 to the bar 124 gives a long leveling range in one direction and a short range in the opposite direction. As previously described in connection with the preferred embodiment the frame B′ is rotated with respect to the housing A′ by motor 38*a*** to the optimum position for any given borehole.

The modified device in FIGS. 7 and 8 does not show any clamping or damping means for eliminating bumping of the instrument on the housing A′ or frame B′ when the device is being transported or being moved in the well bore. A simple way of providing damping is to fasten a cylinder to the two discs **22*a* and 24*a*** so as to form a sealed container around the instrument C′ which can be filled with a damping fluid.

As shown in FIGS. 7 and 8 the components shown and described with reference to the preferred embodiment are assigned the same letter with a prime and the same number with the suffix *a.*

What is claimed is:

1. A device for leveling an instrument comprising:

a housing having a dimension which is substantially longer than the housing dimensions normal to said long dimension, a frame, means for rotating said frame about a rotation axis substantially parallel to said long housing dimension, an instrument having a reference axis which is to be positioned approximately vertical for good instrument performance, means for tilting said instrument relative to said frame about two tilt axes substantially normal to said rotation axis and at an angle to each other, one of said tilt means having a long range of tilt, the other of said tilt means having a shorter range of tilt, said instrument being mounted in said tilt means to align its reference axis parallel to said rotation axis when said long range tilt means is near one end of its range and when the short range tilt means is near the center of its range, means for indicating the amount of tilt of said long range tilt means relative to said frame, and leveling indicating means in fixed relation to said instrument to indicate when said instrument reference axis is vertical.

2. A device for leveling an instrument comprising:

a housing having a dimension which is substantially longer than the housing dimensions normal to said long dimension, a frame, means for rotating said frame about a rotation axis substantially parallel to said long housing dimension, an instrument having a reference axis which is to be positioned approximately vertical for good instrument performance, means for tilting said instrument relative to said frame about a tilt axis normal to said rotation axis, said instrument being mounted in said tilt means to align its reference axis parallel to said rotation axis when said tilt means is near one end of its range, means for limiting the range of said tilt means, and level indicating means in fixed relation to said instrument to indicate when said instrument reference axis is vertical.

3. A device for leveling an instrument comprising:

a housing having a dimension which is substantially longer than the housing dimensions normal to said long dimension, a frame, means for rotating said frame about a rotation axis substantially parallel to said long housing dimension, an instrument having a reference axis which is to be positioned approximately vertical for good instrument performance, means for tilting said instrument relative to said frame about two tilt axes substantially normal to said rotation axis and at an angle to each other, one of said tilt means having a long range of tilt, the other of said tilt means having a shorter range of tilt, said instrument being mounted in said tilt means to align its reference axis parallel to said rotation axis when said long range tilt means is near one end of its range and when the short range tilt means is near the center of its range, level indicating means in fixed relation to said frame, and level indicating means in fixed relation to said instrument to indicate when said instrument reference axis is vertical.

4. An apparatus for leveling an instrument within a well bore comprising:

a housing having a transverse dimension capable of being lowered into the well bore and a longitudinal axis which is generally parallel with the axis of the well bore when the housing is within said well bore, a frame mounted within said housing, an instrument having a reference axis which is to be approximately vertical for best operation of the instrument, means for mounting said instrument within said frame and for tilting said instrument relative to said frame about an axis extending substantially normal to said longitudinal axis of said housing, means for indicating the level of said instrument about two axes with one of said axes being aligned with the axis about which said tilting means tilts said instrument and the other of said axes being substantially normal to the tilt axis and said longitudinal axis of said housing, and means for rotating said frame relative to said housing whereby the instrument may be positioned with its maximum inclination in a direction which may be brought to a substantially vertical position by operation of said tilting means.

5. An apparatus according to claim 4, wherein said instrument is mounted within said frame by said mounting means in an unsymmetrical position so that its maximum direction of movement available is aligned with the axis of its movement by said tilting means.

6. An apparatus according to claim 4, including a second tilting means for tilting said instrument about an axis normal to the axis about which said other tilting means tilts said instrument.

7. An apparatus according to claim 4, including means for stopping the rotation of said frame in said housing to assure that it does not continue to rotate in the same direction with each rotation.

8. An apparatus according to claim 4, including limit switches mounted on said frame to stop the travel of said tilting means as it reaches the end of its travel.

9. An apparatus according to claim 4, including a potentiometer connected to said tilt means and having an output indicative of the position of said tilt means.

10. An apparatus according to claim 4, including means for indicating the level of said frame about two axes which are substantially parallel to the two axes of the level indicating means on said instrument.

11. The method of leveling an instrument within a well bore wherein the instrument is mounted within a frame and is tiltable relative thereto and the frame is mounted within a housing and is rotatable relative to the housing including the steps of:

detecting the tilt of the instrument in two axes at an angle to each other and substantailly normal to the longitudinal axis of the housing, aligning the axis of one of said tilt detections to a maximum, and tilting the instrument to substantially eliminate said maximum tilt.

12. The method according to claim 11 wherein:

said aligning step is performed by rotating the frame within said housing.

13. The method of leveling an instrument within a well bore wherein the instrument is mounted within a frame and is tiltable relative thereto and the frame is mounted within a housing and is rotatable relative to the housing, including the steps of:

orienting the instrument within the well bore by rotation of the frame within said housing to position the instrument with its maximum tilt in the direction in which said instrument is tiltable within said frame, and tilting the instrument within the frame to bring the reference axis of the instrument substantially to vertical.

14. The method according to claim 13 including the steps of initially aligning the reference axis of the instrument to a position substantially parallel with the longitudinal axis of said housing.

15. A device for leveling an instrument, comprising a housing having a transverse dimension capable of being lowered into a well bore, an instrument having a reference axis which is to be approximately vertical for best operation of the instrument, means for mounting said instrument within said housing whereby when the reference axis of said instrument is substantially parallel with the longitudinal axis of said housing said instrument is offset to one side of said housing, means for rotating said mounting means and said instrument with respect to said housing, and means for indicating the desired position of said mounting means and said instrument with respect to the inclination of said housing whereby when said housing is inclined said mounting means and said instrument may be rotated to a position allowing the movement of said instrument to position its reference axis substantially vertical.

16. A device according to claim 15, wherein said mounting means includes a frame rotationally mounted within said housing and rotatable by said rotating means, and a gimbal mounting said instrument to said frame in free swinging relationship therewith whereby when said frame is rotated to the desired position said instrument is moved responsive to gravity to a position in which its reference axis is substantially vertical.

* * * * *